US010513879B2

(12) United States Patent
Huang

(10) Patent No.: US 10,513,879 B2
(45) Date of Patent: Dec. 24, 2019

(54) VENETIAN BLIND

(71) Applicant: TAICANG KINGFU PLASTIC MANUFACTURE CO., LTD., Taicang, Jiangshu Province (CN)

(72) Inventor: Szu-Chang Huang, Fusing Township, Changhua County (TW)

(73) Assignee: TAICANG KINGFU PLASTIC MANUFACTURE CO., LTD., Taicang, Jiangshu Province (CN)

( * ) Notice: Subject to any disclaimer, the term of this patent is extended or adjusted under 35 U.S.C. 154(b) by 145 days.

(21) Appl. No.: 15/623,976

(22) Filed: Jun. 15, 2017

(65) Prior Publication Data

US 2018/0363364 A1 Dec. 20, 2018

(51) Int. Cl.

| | |
|---|---|
| ***E06B 7/096*** | (2006.01) |
| ***E06B 7/086*** | (2006.01) |
| ***E06B 9/28*** | (2006.01) |
| ***E06B 3/38*** | (2006.01) |
| ***E06B 3/50*** | (2006.01) |
| ***E06B 7/084*** | (2006.01) |

(52) U.S. Cl.

CPC ..... *E06B 7/096* (2013.01); *E06B 3/38* (2013.01); *E06B 3/5036* (2013.01); *E06B 7/084* (2013.01); *E06B 7/086* (2013.01); *E06B 9/28* (2013.01)

(58) Field of Classification Search

CPC ..... E06B 7/096
USPC ..... 49/74.1, 89.1, 87.1, 90.1
See application file for complete search history.

(56) References Cited

U.S. PATENT DOCUMENTS

| | | | | |
|---|---|---|---|---|
| 4,502,523 | A * | 3/1985 | Anderson | E06B 9/28 160/107 |
| 4,724,634 | A * | 2/1988 | Blum | E06B 9/01 160/92 |
| 5,584,331 | A * | 12/1996 | Lin | E06B 7/086 160/172 R |
| 6,038,816 | A * | 3/2000 | Park | E06B 9/303 49/64 |
| 6,145,251 | A * | 11/2000 | Ricci | E06B 7/096 49/74.1 |
| 7,353,636 | B1 * | 4/2008 | Anderson | E06B 7/086 49/74.1 |
| 2002/0056231 | A1 * | 5/2002 | Blachley | E06B 7/086 49/87.1 |

(Continued)

FOREIGN PATENT DOCUMENTS

| | | | | |
|---|---|---|---|---|
| CA | 2733483 | A1 * | 9/2012 | E06B 7/086 |
| JP | 2004124366 | A * | 4/2004 | E06B 7/086 |

*Primary Examiner* — Marcus Menezes
(74) *Attorney, Agent, or Firm* — Birch, Stewart, Kolasch & Birch, LLP

(57) ABSTRACT

A venetian blind includes a frame unit, a slat unit, a transmission unit, and an operating unit. The slat unit includes multiple drive axles and a plurality of slats each connected co-rotatably to the drive axles. The transmission unit includes two transmission rollers, a plurality of constant-force coil springs that are linked together and that are coupled to the drive axles, and a belt that cooperates with the constant-force coil springs to form a loop trained on the transmission rollers. The operating unit includes an inner control member connected to the belt, and an outer control member operable to drive the inner control member to move so as to drive rotation of the drive axles via the constant-force coil springs to rotate the slats.

14 Claims, 8 Drawing Sheets

(56) References Cited

U.S. PATENT DOCUMENTS

2008/0271378 A1* 11/2008 Le ..... E06B 7/086
49/89.1
2015/0020452 A1* 1/2015 Chen ..... E06B 7/09
49/82.1

* cited by examiner

VENETIAN BLIND

FIELD

The disclosure relates to a venetian blind, and more particularly to a venetian blind with adjustable slat angle.

BACKGROUND

Referring to FIG. 1, a conventional venetian blind 1, as disclosed in Taiwanese Utility Patent No. M306267, includes a frame 11, a plurality of slats 12 rotatably connected to the frame 11, a plurality of rotary members 13 each connected fixedly to an end of a respective one of the slats 12, a bead chain 14 trained on the rotary members 13, and an operating member 15 connected to the bead chain 14 and movable relative to the frame 11. When the operating member 15 is moved upward or downward relative to the frame 11, the operating member 15 drives rotation of the bead chain 14 so as to rotate the rotary members 13. The slats 12 rotate together with the rotary members 13 so that the slat angle is adjusted.

However, each of the slats 12 has an angle of rotation less than 90 degrees, which means that the bead chain 14 has to drive the rotation of the rotary members 13 by moving a relatively short distance, which is relatively difficult to operate and may be laborious for an operator.

SUMMARY

Therefore, an object of the disclosure is to provide a venetian blind that can alleviate at least the drawback of the prior art.

According to the disclosure, the venetian blind includes a frame unit, a slat unit, a transmission unit, and an operating unit.

The slat unit includes a plurality of spaced-apart axle sets arranged in a first direction. Each of the axle sets includes two drive axles that are aligned with each other and that are rotatably connected to the frame unit. The slat unit further includes a plurality of slats. Each of the slats is connected co-rotatably between the drive axles of a respective one of the axle sets.

The transmission unit includes two transmission rollers, a plurality of constant-force coil springs, and a belt. The transmission rollers are connected rotatably to the frame unit and disposed respectively at opposite sides of the salt unit in the first direction. The constant-force coil springs are disposed between the transmission rollers, are arranged in the first direction, and are linked together. One of the drive axles of each of the axle sets is coupled co-rotatably to a respective one of the constant-force coil springs. The belt is connected to the constant-force coil springs, and cooperates with the constant-force coil springs to form a loop trained on the transmission rollers such that, for each of the slats, a restoring force of a respective one of the constant-force coil springs exerted thereon which drives the slat to rotate in a first rotational direction substantially counteracts a force of gravity exerted thereon which prevents the slat to rotate in the first rotational direction.

The operating unit includes an inner control member that is disposed in the frame unit and that is connected to the belt, and an outer control member that is disposed outside of the frame unit, and that is operable to drive the inner control member to move so as to drive rotation of the drive axles via the constant-force coil springs to rotate the slats.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
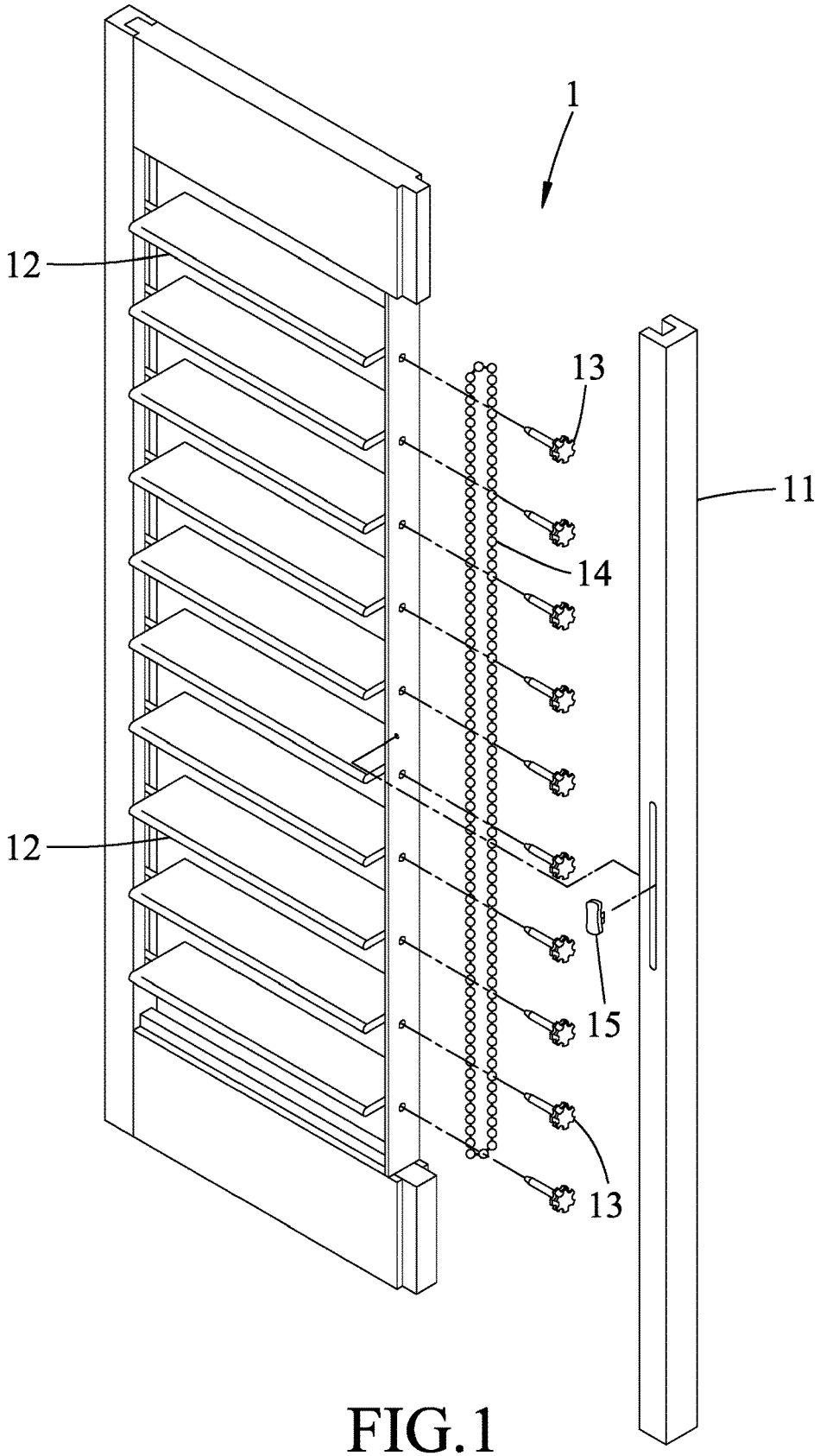
FIG.1 PRIOR ART
FIG. 1 is a partly exploded perspective view of a conventional venetian blind disclosed in Taiwanese Utility Patent No. M306267.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
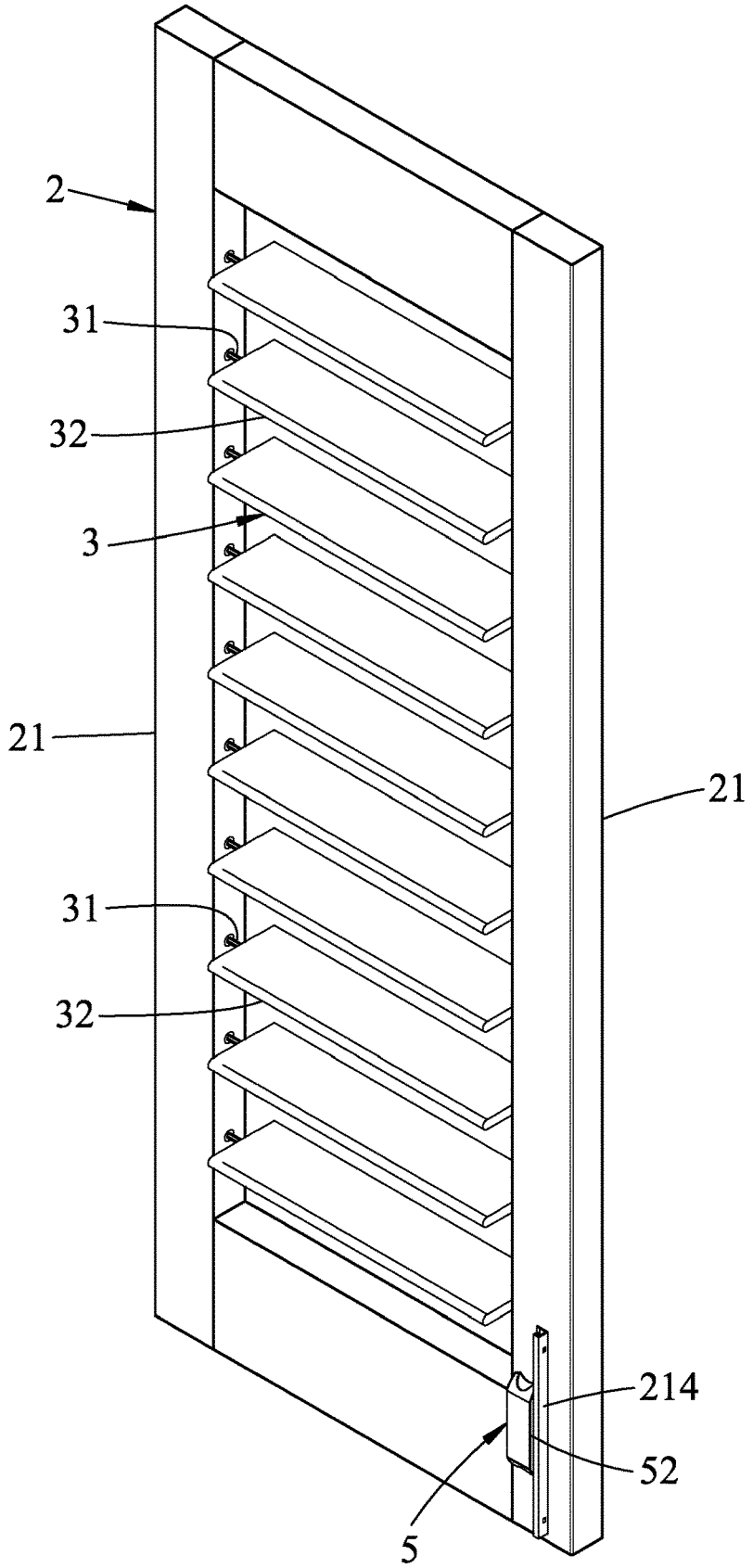
FIG. 2 is a perspective view illustrating a first embodiment of a venetian blind according to the disclosure.
Figure 3:
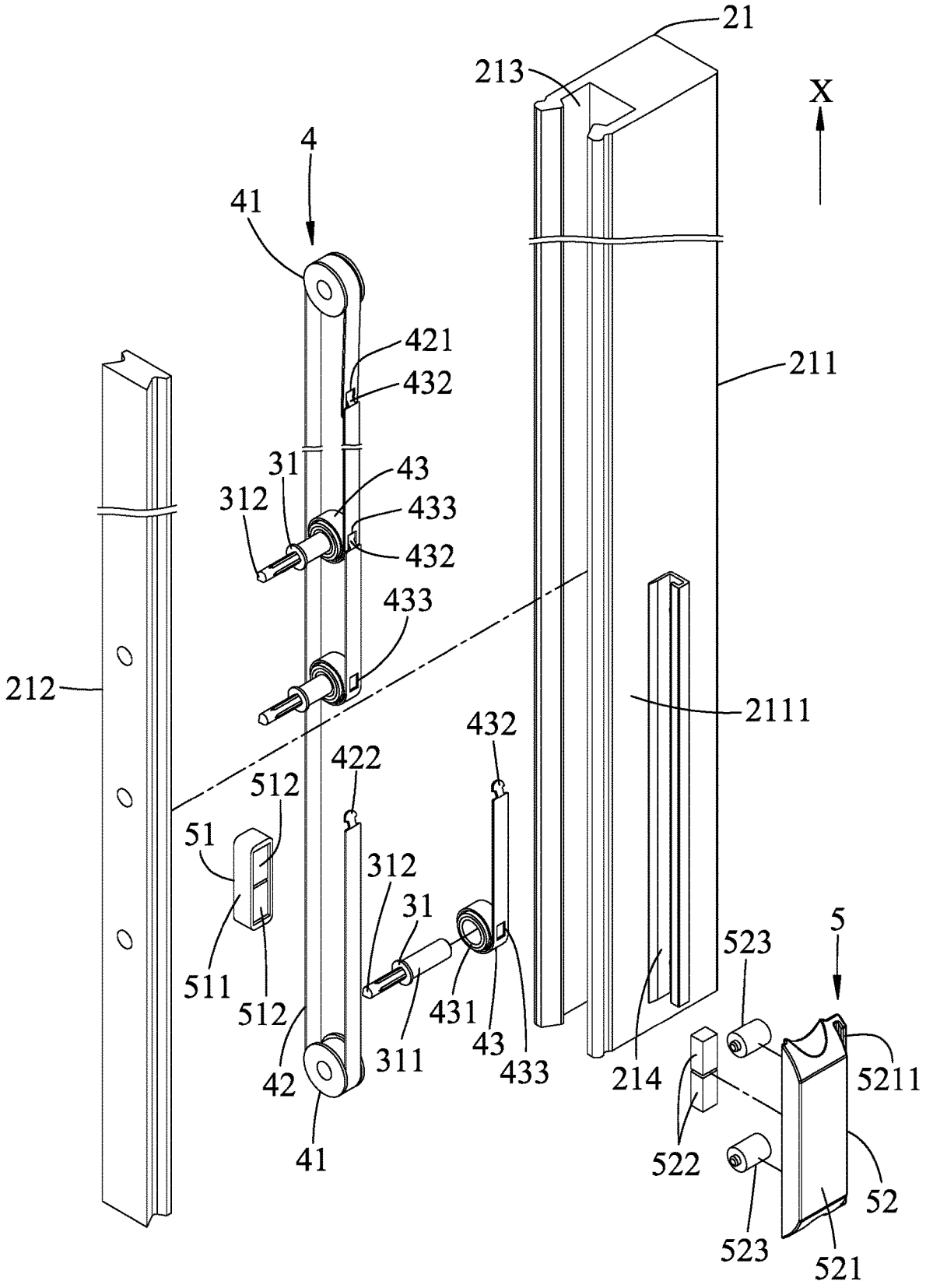
FIG. 3 is a fragmentary partly exploded perspective view of a side frame, a transmission unit, and an operating unit of the first embodiment.
Figure 4:
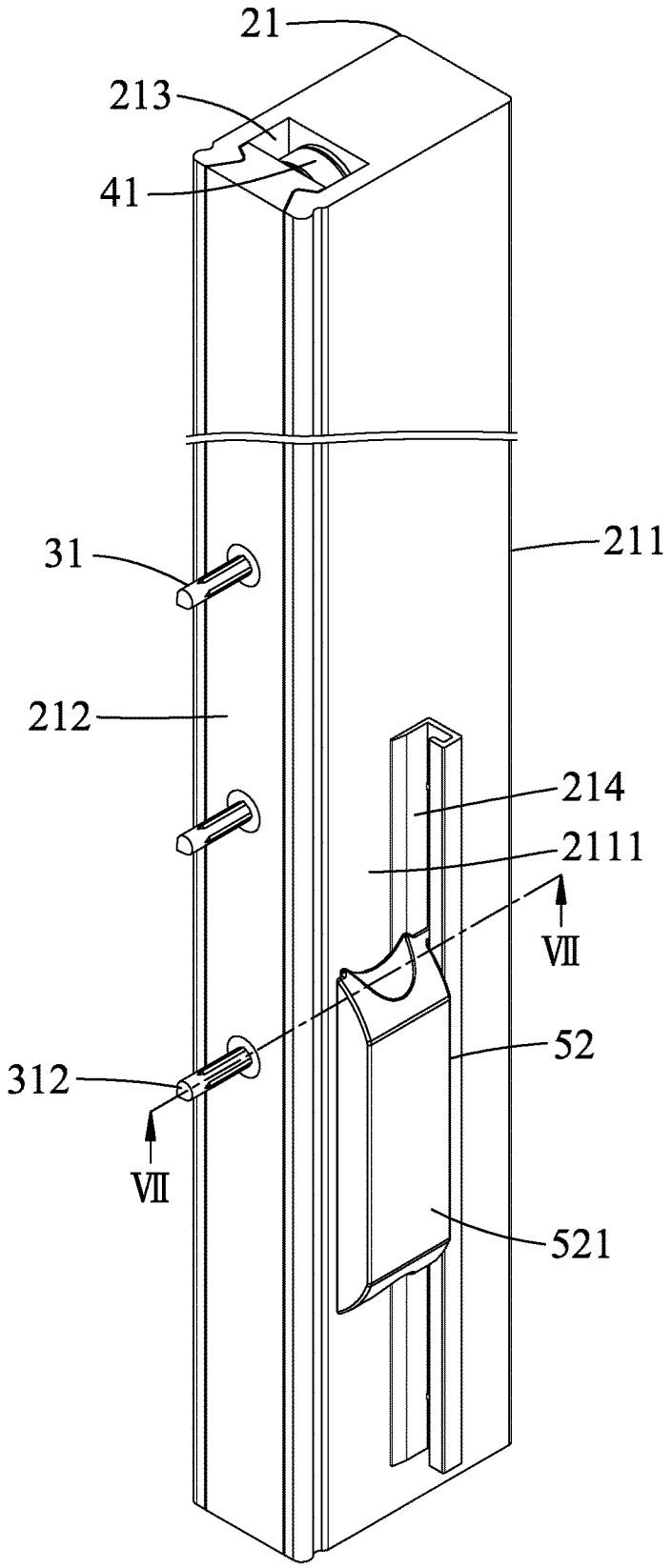
FIG. 4 is a fragmentary assembled perspective view of the side frame, the transmission unit, and the operating unit.

Referring to FIGS. 2 to 4, a first embodiment of a venetian blind includes a frame unit 2, a slat unit 3, a transmission unit 4, and an operating unit 5.

The frame unit 2 includes two side frames 21 spaced apart from each other. One of the side frames 21 includes a hollow frame seat 211, a bar 212, and a slide rail 214.

The frame seat 211 extends in a first direction (X). The bar 212 extends in the first direction (X), is coupled to the frame seat 211, and cooperates with the frame seat 211 to define an accommodating space 213. The slide rail 214 is disposed on an outer surface 2111 of the one of the side frames 21, and extends in the first direction (X).

The slat unit 3 includes a plurality of spaced-apart axle sets and a plurality of slats 32. The axle sets are arranged in the first direction (X). Each of the axle sets includes two drive axles 31 that are aligned with each other and that are rotatably connected to the frame unit 2. Each of the slats 32 is connected co-rotatably between the drive axles 31 of a respective one of the axle sets. More specifically, each axle sets has one of the drive axles 31 extending rotatably through the bar 212 and having a head portion 311 and a connecting portion 312. The head portion 311 is received in the accommodating space 213. The connecting portion 312 is connected to a respective one of the slats 32.

The transmission unit 4 is accommodated in the accommodating space 213, and includes two transmission rollers 41, a plurality of constant-force coil springs 43, and a belt 42.

The transmission rollers 41 are connected rotatably to the one of the side frames 21 of the frame unit 2, and are disposed respectively at opposite sides of the slat unit 3 in the first direction (X). The constant-force coil springs 43 are disposed between the transmission rollers 41, are arranged in the first direction (X), and are linked together. The head portion 311 of the one of the drive axles 31 of each of the axle sets is coupled co-rotatably to a respective one of the constant-force coil springs 43. Each of the constant-force coil springs 43 has a connecting end portion 431 wound on the one of the drive axles 31 of the respective one of the drive axle sets, a hook end portion 432 opposite to the connecting end portion 431, and a hook-engaging portion 433 disposed between the connecting end portion 431 and the hook end portion 432 and proximate to the hook end portion 432. The hook end portion 432 of each of the constant-force coil springs 43 engages the hook-engaging portion 433 of an adjacent one of the constant-force coil springs 43 so that the constant-force coil springs 43 are linearly linked together.

The belt 42 is made from a magnetically conductive material. The belt 42 is connected to the constant-force coil springs 43, and cooperates with the constant-force coil springs 43 to form a loop trained on the transmission rollers 41. Specifically, the belt 42 has a hook end 422 engaging the hook-engaging portion 433 of one of opposite endmost ones of the constant-force coil springs 43, and a hook-engaging end 421 opposite to the hook end 422 and engaging the hook end portion 432 of the other one of the opposite endmost ones of the constant-force coil springs 43 so as to form the loop. As such, for each of the slats 32, a restoring force of a respective one of the constant-force coil springs 43 exerted thereon which drives the slat 32 to rotate in a first rotational direction (i.e., a clockwise direction in FIG. 5) substantially counteracts a force of gravity exerted thereon which prevents the slat 32 to rotate in the first rotational direction.

The operating unit 5 is disposed on the one of the side frames 21 which has the accommodating space 213. The operating unit 5 includes an inner control member 51 and an outer control member 52.

The inner control member 51 is disposed in the accommodating space 213 of the frame unit 2, and is connected to the belt 42. The inner control member 51 includes a housing 511 and two inner magnetic elements 512 disposed in the housing 511 and attached to the belt 42.

The outer control member 52 is disposed on the outer surface 2111 of the one of the side frames 21 of the frame unit 2 (i.e., the outer control member 52 is disposed outside of the one of the side frames 21), and is operable to drive the inner control member 51 to move so as to drive rotation of the drive axles 31 via the constant-force coil springs 43 to rotate the slats 32. The outer control member 52 includes an operating piece 521 that is configured to be slidable on the outer surface 2111 of the one of the side frames 21 of the frame unit 2. More specifically, referring further to FIG. 7, the operating piece 521 has a rail-engaging portion 5211 that slidably engages the slide rail 214 so as to permit the operating piece 521 to be slidable. In this embodiment, the outer control member 52 further includes two outer magnetic elements 522 and two rollers 523. The outer magnetic elements 522 are disposed in the operating piece 521, and are magnetically and respectively attracted to the inner magnetic elements 512 for providing a magnetic force so that the slide movement of the outer control member 52 drives the movement of the inner control member 51. The rollers 523 are disposed in the operating piece 521, and are in rolling contact with the outer surface 2111 of the one of the side frames 21.

Figure 5:
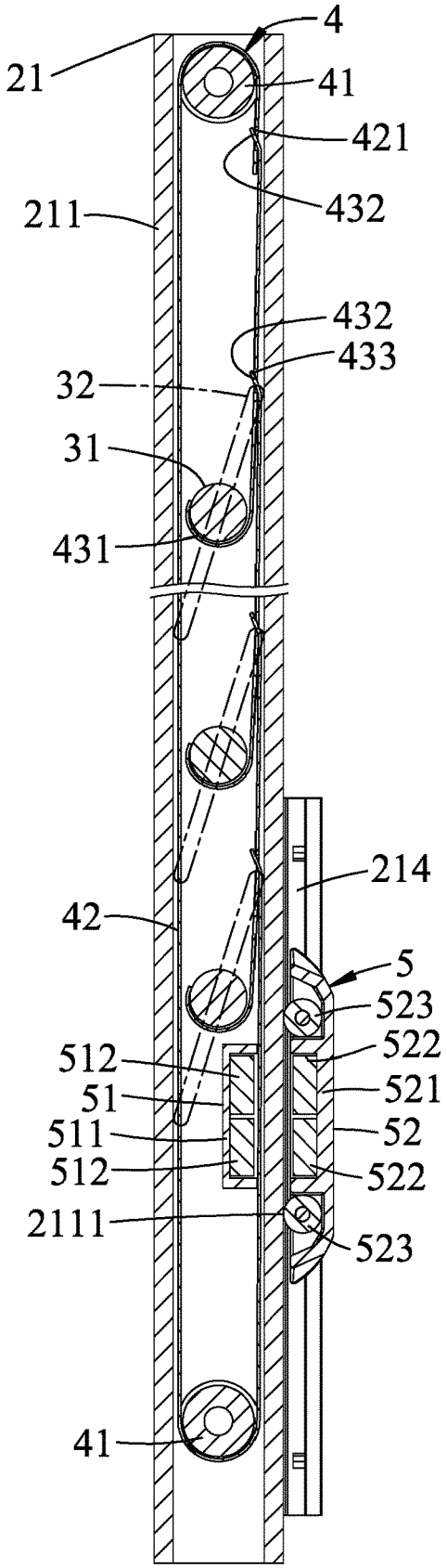
FIG. 5 is a fragmentary sectional view of the first embodiment, illustrating an outer control member of the operating unit at a first position.
Figure 6:
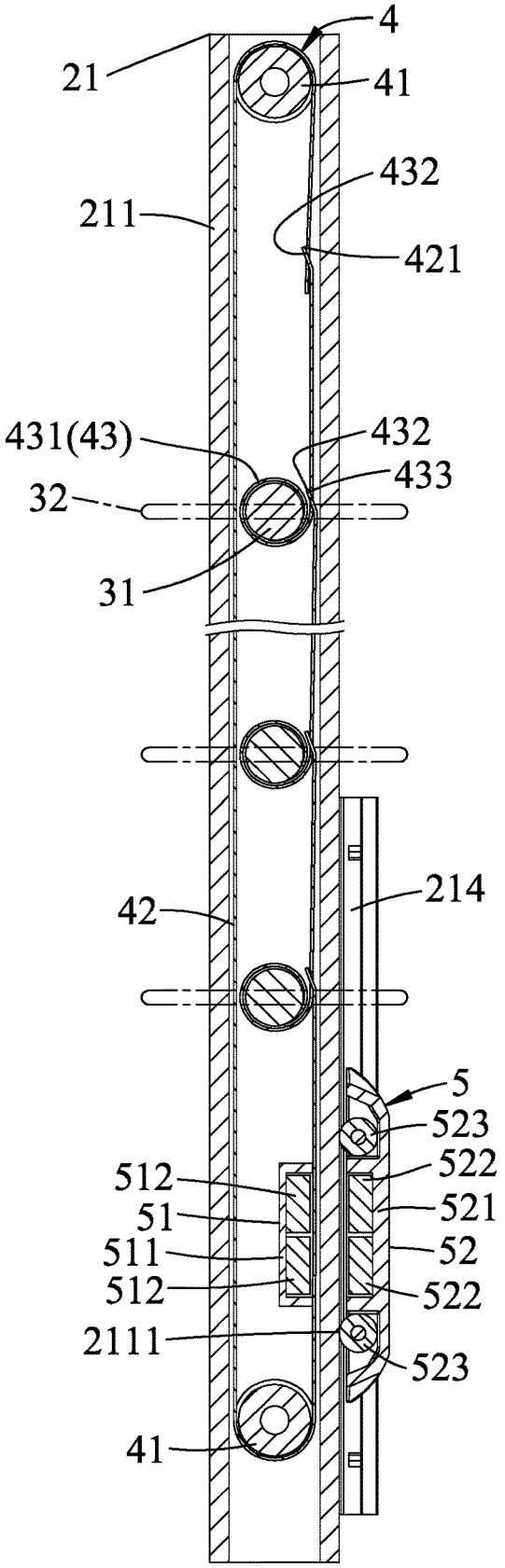
FIG. 6 is a view similar to FIG. 5, but illustrating the outer control member at a second position.
Figure 7:
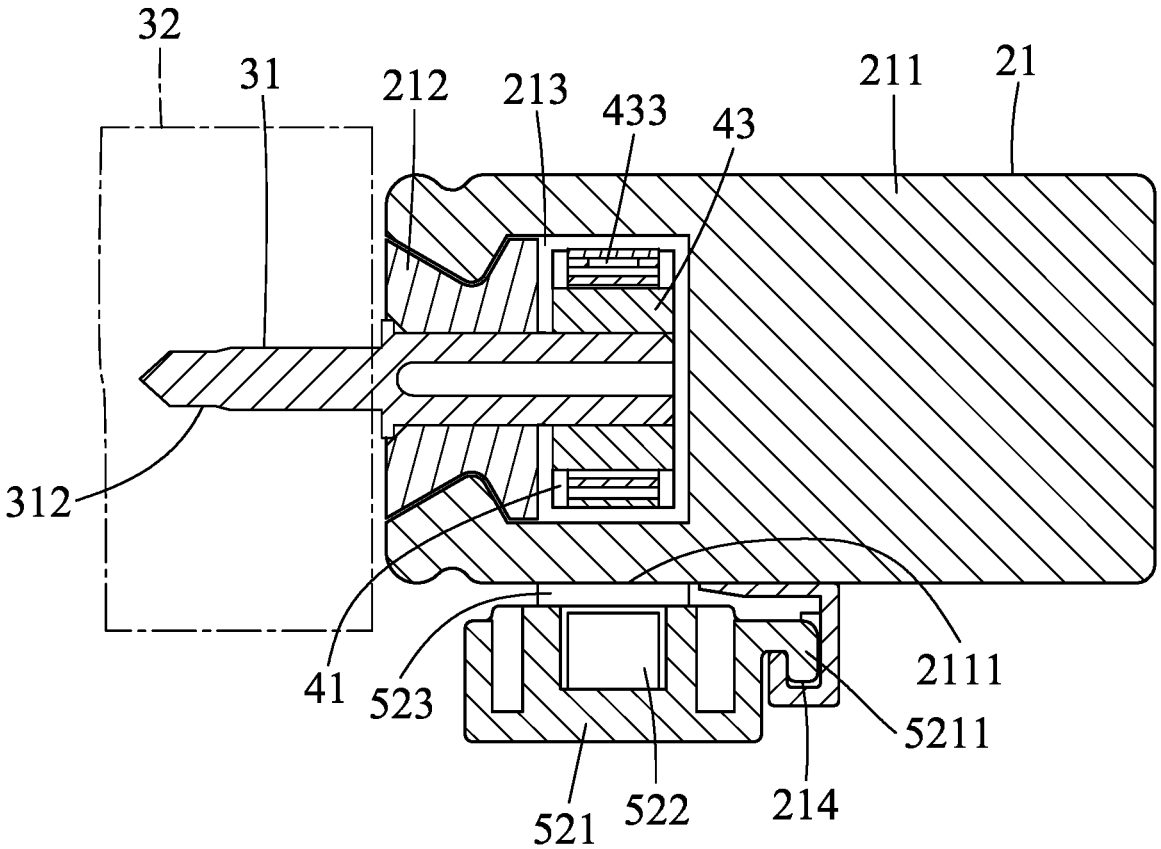
FIG. 7 is a sectional view taken along line VII-VII of FIG. 4, illustrating the side frame, the transmission unit, and the operating unit.

Referring to FIGS. 5 to 7, the outer control member 52 is movable relative to the frame unit 2 between a first position (see FIG. 5) and a second position (see FIG. 6). When the outer control member 52 is moved from the first position to the second position, the constant-force coil springs 43 are wound to drive movement of the belt 42 and to drive rotation of the drive axles 31 in the first rotational direction to rotate the slats 32, so that the slats 32 are open and each of the slats 32 is substantially disposed horizontally when the outer control member 52 is at the second position.

When the outer control member 52 is moved from the second position to the first position, the constant-force coil springs 43 are unwound to drive rotation of the drive axles 31 in a second rotational direction which is opposite to the first rotational direction to reversely rotate the slats 32, so that the slats 32 are closed and each of the slats 32 is substantially disposed vertically when the outer control member 52 is at the first position. When the outer control member 52 slides and stops at one of the first and second positions or at any point therebetween, orientation of the slats 32 (i.e., the slat angle) is maintained due to characteristic of the constant-force coil springs 43.

It should be noted that when the outer control member 52 is moved between the first position and the second position, an angle of rotation of each of the slats 32 is less than 95 degrees.

Figure 8:
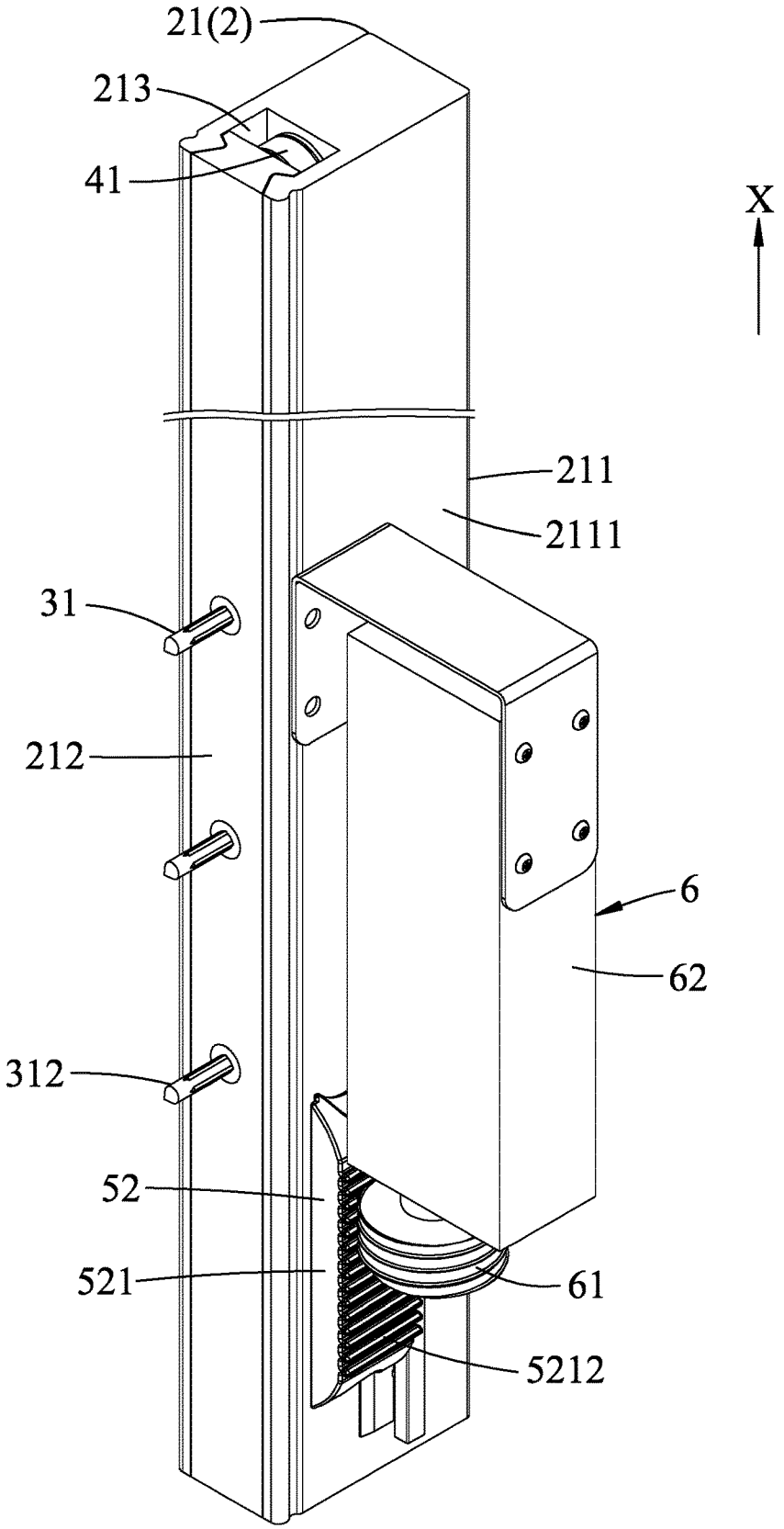
FIG. 8 is a fragmentary perspective view illustrating a second embodiment of the venetian blind according to the disclosure.

Referring to FIG. 8, a second embodiment of the venetian blind according to the disclosure is similar to the first embodiment. The difference between the first and second embodiments resides in that the operating piece 521 of the second embodiment has a corrugated surface 5212, and that the venetian blind of the second embodiment further includes a drive unit 6 disposed for electrically driving the movement of the outer control member 52. The drive unit 6 includes a threaded rod member 61 that engages the corrugated surface 5212 of the outer control member 52, and a motor 62 that is disposed on the frame unit 2 for driving rotation of the threaded rod member 61, thereby resulting in slide movement of the operating piece 521. In this embodiment, the motor 62 is disposed on the outer surface 2111 of the one of the side frames 21.

In summary, the venetian blind of this disclosure is simple in structure and is easy to operate. By virtue of the configuration of the transmission unit 4, the drive axles 31 can be driven to rotate in the first rotational direction or the second rotational direction to adjust the angle of the slats 32 in a smooth and effort-saving manner. The orientation of the slats 32 is maintained when the outer control member 52 is moved to one of the first and second positions or to any point therebetween.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A venetian blind comprising:

a frame unit;

a slat unit including a plurality of spaced-apart axle sets arranged in a first direction, each of said axle sets including two drive axles that are aligned with each other and that are rotatably connected to said frame unit, said slat unit further including a plurality of slats, each of said slats being connected co-rotatably between said drive axles of a respective one of said axle sets;

a transmission unit including two transmission rollers that are connected rotatably to said frame unit, and that are disposed respectively at opposite sides of said slat unit in the first direction, a plurality of constant-force coil springs that are disposed between said transmission rollers, that are arranged in the first direction and that are linked together, one of said drive axles of each of said axle sets being coupled co-rotatably to a respective one of said constant-force coil springs, and a belt that is connected to said constant-force coil springs, and that cooperates with said constant-force coil springs to form a loop trained on said transmission rollers such that, for each of said slats, a restoring force of a respective one of said constant-force coil springs exerted thereon which drives said slat to rotate in a first rotational direction substantially counteracts a force of gravity exerted thereon which prevents said slat to rotate in the first rotational direction; and an operating unit including an inner control member that is disposed in said frame unit and that is connected to said belt, and an outer control member that is disposed outside of said frame unit, and that is operable to drive said inner control member to move so as to drive rotation of said drive axles via said constant-force coil springs to rotate said slats.

2. The venetian blind as claimed in claim 1, wherein:

each of said constant-force coil springs has a connecting end portion wound on said one of said drive axles of the respective one of said drive axle sets, a hook end portion opposite to said connecting end portion, and a hook-engaging portion disposed between said connecting end portion and said hook end portion and proximate to said hook end portion, said hook end portion of each of said constant-force coil springs engaging said hook-engaging portion of an adjacent one of said constant-force coil springs so that said constant-force coil springs are linearly linked together; and said belt has a hook end engaging said hook-engaging portion of one of opposite endmost ones of said constant-force coil springs, and a hook-engaging end opposite to said hook end and engaging said hook end portion of the other one of said opposite endmost ones of said constant-force coil springs so as to form said loop.

3. The venetian blind as claimed in claim 1, further comprising a drive unit disposed for electrically driving movement of said outer control member.

4. The venetian blind as claimed in claim 3, wherein:

said outer control member includes an operating piece that is configured to be slidable on said frame unit, and that has a corrugated surface; and said drive unit includes a threaded rod member that engages said corrugated surface of said outer control member, and a motor that is disposed on said frame unit for driving rotation of said threaded rod member, thereby resulting in slide movement of said operating piece.

5. The venetian blind as claimed in claim 4, wherein:

said belt is made from a magnetically conductive material;

said inner control member includes a housing, and at least one inner magnetic element disposed in said housing, and being attached to said belt; and said outer control member further includes at least one outer magnetic element disposed in said operating piece and magnetically attracted to said at least one inner magnetic element for providing a magnetic force so that slide movement of said outer control member drives the movement of the inner control member.

6. The venetian blind as claimed in claim 1, wherein:

said belt is made from a magnetically conductive material;

said inner control member includes a housing, and at least one inner magnetic element disposed in said housing, and being attached to said belt; and said outer control member includes at least one outer magnetic element magnetically attracted to said at least one inner magnetic element for providing a magnetic force so that movement of said outer control member drives movement of the inner control member.

7. The venetian blind as claimed in claim 5, wherein:

said frame unit includes two side frames spaced apart from each other, one of said side frames including a hollow frame seat that extends in the first direction, and a bar that extends in the first direction, that is coupled to said frame seat, and that cooperates with said frame seat to define an accommodating space accommodating said transmission unit therein; and each axle sets has one of said drive axles extending rotatably through said bar, and having a head portion that is received in said accommodating space and that is coupled co-rotatably to the respective one of said constant-force coil springs, and a connecting portion that is connected to a respective one of said slats.

8. The venetian blind as claimed in claim 7, wherein said one of said side frames further includes a slide rail disposed on an outer surface of one of said side frames and extending in the first direction, said operating piece of said outer control member having a rail-engaging portion that slidably engages said slide rail so as to permit said operating piece to be slidable.

9. The venetian blind as claimed in claim 8, wherein said outer control member further includes at least one roller disposed in said operating piece and being in rolling contact with said outer surface of said one of said side frames.

10. The venetian blind as claimed in claim 6, wherein:

said frame unit includes two side frames spaced apart from each other, one of said side frames including a hollow frame seat that extends in the first direction, and a bar that extends in the first direction, that is coupled to said frame seat, and that cooperates with said frame seat to define an accommodating space accommodating said transmission unit therein; and each axle sets has one of said drive axles extending rotatably through said bar, and having a head portion that is received in said accommodating space and that is coupled co-rotatably to the respective one of said constant-force coil springs, and a connecting portion that is connected to a respective one of said slats.

11. The venetian blind as claimed in claim 10, wherein said one of said side frames further includes a slide rail disposed on an outer surface of said one of said side frames and extending in the first direction, said outer control member of said operating unit further including an operating piece that is configured to be slidable on said frame unit, said operating piece of said outer control member having a rail-engaging portion that slidably engages said slide rail so as to permit said operating piece to be slidable.

12. The venetian blind as claimed in claim 11, wherein said outer control member further includes at least one roller disposed in said operating piece and being in rolling contact with said outer surface of said one of said side frames.

13. The venetian blind as claimed in claim 1, wherein: said outer control member is movable relative to said frame unit between a first position and a second position;

when said outer control member is moved from the first position to the second position, said constant-force coil springs are wound to drive rotation of said drive axles in the first rotational direction to rotate said slats; and when said outer control member is moved from the second position to the first position, said constant-force coil springs are unwound to drive rotation of said drive axles in a second rotational direction which is opposite to the first rotational direction to reversely rotate said slats.

14. The venetian blind as claimed in claim 13, wherein when said outer control member is moved between the first position and the second position, an angle of rotation of each of said slats is less than 95 degrees.

* * * * *